United States Patent [10]

Shanmugasundaram

[11] 4,045,923

[45] Sept. 6, 1977

[54] TELESCOPIC SWINGAWAY JIB

[75] Inventor: Venkatachalam Shanmugasundaram, Chambersburg, Pa.

[73] Assignee: Walter Kidde & Company, Inc., Clifton, N.J.

[21] Appl. No.: 683,747

[22] Filed: May 6, 1976

[51] Int. Cl.[2] ..... B66C 23/04

[52] U.S. Cl. ..... 52/118; 212/55; 212/144

[58] Field of Search ..... 52/111, 118, 115; 212/55, 59 R, 144, 54

[56] References Cited

U.S. PATENT DOCUMENTS

| | | | |
|---|---|---|---|
| 2,787,383 | 4/1957 | Antos et al. | 212/55 X |
| 3,259,251 | 7/1966 | Stauffer | 212/55 |
| 3,341,029 | 9/1967 | Barkley et al. | 212/55 |
| 3,407,947 | 10/1968 | Valla | 212/55 X |
| 3,445,004 | 5/1969 | Grider et al. | 212/55 |
| 3,669,281 | 6/1972 | Woodside | 212/59 R |
| 3,719,403 | 3/1973 | Sung | 212/55 |
| 3,754,666 | 8/1973 | Surerkrop | 212/55 X |
| 3,785,505 | 1/1974 | Keller, Jr. | 212/55 X |
| 3,796,016 | 3/1974 | Wu | 212/55 X |
| 3,972,571 | 8/1976 | Benkowski | 212/55 X |

*Primary Examiner*—Leslie Braun

*Attorney, Agent, or Firm*—Brady, O'Boyle & Gates

[57] ABSTRACT

A telescopic extension jib for crane booms increases the reach of the boom and therefore increases the utility of the construction crane. To facilitate manual extension and retraction of the movable jib section relative to the fixed base section, a system of rollers is employed between the relatively movable jib sections. In the socketing area of the jib at full jib extension, upper and lower rollers are spring-mounted and can bear the dead weight of the movable jib section when the same is unloaded. Coacting bearing pads engage the top and bottom faces of the movable jib section under loading to distribute stresses over larger areas, the spring-mounted rollers retracting automatically to enable the movable jib section to engage the bearing pads in the socketing area. A locating pin is provided to lock the jib sections against accidental relative movement in both the extended and retracted positions of the jib.

8 Claims, 14 Drawing Figures

FIG. 11
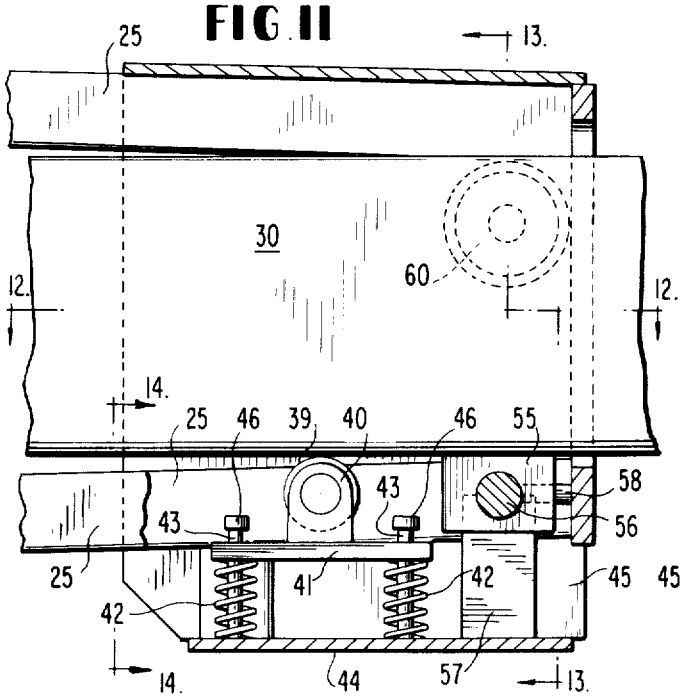
FIG. 10
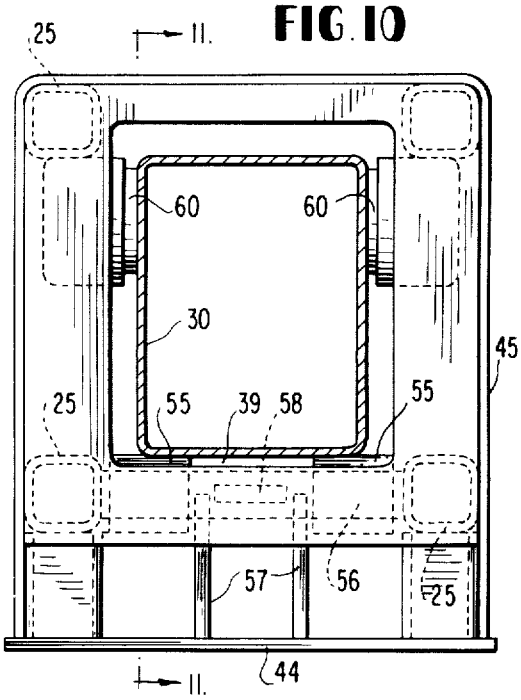
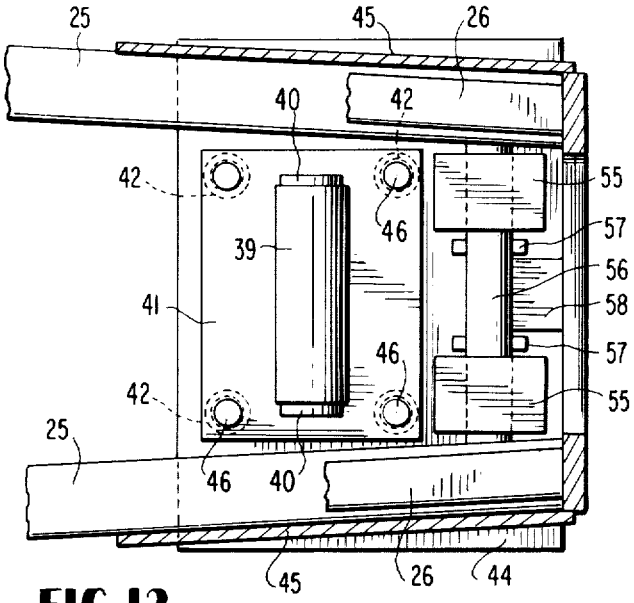
FIG. 12
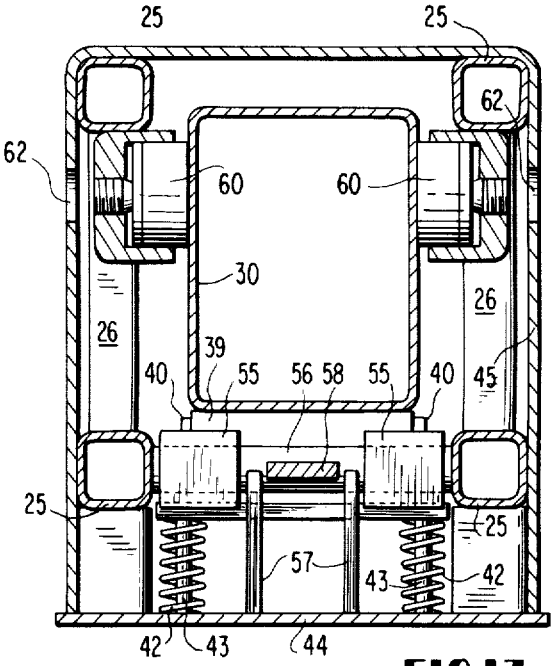
FIG. 13
FIG. 14
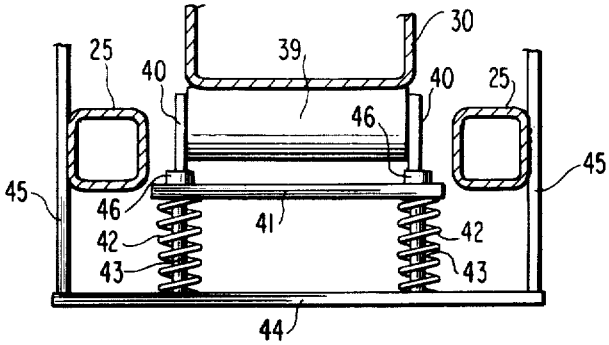

TELESCOPIC SWINGAWAY JIB

BACKGROUND OF THE INVENTION

Telescopic extension jibs for crane booms have been employed in the prior art but have not been completely practical because of the extreme difficulty of manual manipulation of the movable jib section. Most construction cranes have no more than two operators and many have only a single operator. It is extremely difficult, if not impossible, for one operator or even two to extend the interior movable section of a telescopic jib due to the massiveness of the same and the high friction forces which resist manual manipulation. In some instances, crane operators have resorted to unusual procedures such as securing the movable section of the jib to some fixed structure and backing up the crane to extend the jib. This is highly inconvenient and could result in damage to the jib or other parts of the crane and the procedure is not advisable.

Accordingly, the objective of this invention is to provide a telescopic extension jib for crane booms which can easily be extended and retracted manually by one operator and is therefore completely practical and convenient to use. The extension jib increases the reach of the crane boom and thus increases the overall utility of the crane in comparison to cranes having nontelescopic extension jibs.

SUMMARY OF THE INVENTION

In carrying out the invention with economy, a lattice-type jib section of suitable length is provided and adapted for attachment to the leading end of the fly section of a hydraulically operated construction crane boom or to another type of crane boom, if preferred. A box section movable jib component or section is received telescopically in the jib base section and a positive safety locking pin means between the two jib sections is provided to lock them against movement in the fully extended and fully retracted positions.

To allow easy manual movement of the interior jib section relative to the base section, low friction guide rollers are provided on the jib base section at suitable points to engage and guide the movable jib section in all adjusted positions of the latter. In the socketing area of the two jib sections, when the telescopic jib is fully extended, an upper guide roller and a lower guide roller are spring-mounted on the jib base section with sufficient spring-loading to enable the two rollers to support the dead weight of the fully extended movable jib section without an external load thereon.

Adjacent the spring-mounted rollers, coacting upper and lower longitudinally spaced bearing pads are provided in the socketing area on the jib base section to engage and bear the weight of the movable jib section when the same is loaded. The two spring-mounted rollers yield and retract automatically when the movable jib section is loaded to allow the transfer of its weight to the flat bearing pads which serve to distribute stresses over relatively large areas, thus avoiding local stress concentrations in the jib components which would exist if the jib guide rollers were rigidly mounted and bore the entire weight of the loaded movable jib section.

The jib is additionally equipped with side adjustable wear pads between the fixed and movable sections of the jib and a stop element on the rear of the movable jib section limits forward manual extension.

Other features and advantages of the invention will become apparent during the course of the following detailed description. It is understood that the same construction can also be used for a manual outer section of a telescopic boom.

BRIEF DESCRIPTION OF DRAWING FIGURES

FIG. 10 is an enlarged transverse vertical section taken on line 10—10 of FIG. 2.

FIG. 11 is a fragmentary vertical section taken on line 11—11 of FIG. 10.

FIG. 12 is a fragmentary horizontal section, with parts omitted, taken on line 12—12 of FIG. 11.

FIG. 13 is a transverse vertical section taken on line 13—13 of FIG. 11.

FIG. 14 is a fragmentary vertical section taken on line 14—14 of FIG. 11.

DETAILED DESCRIPTION

Figure 1:
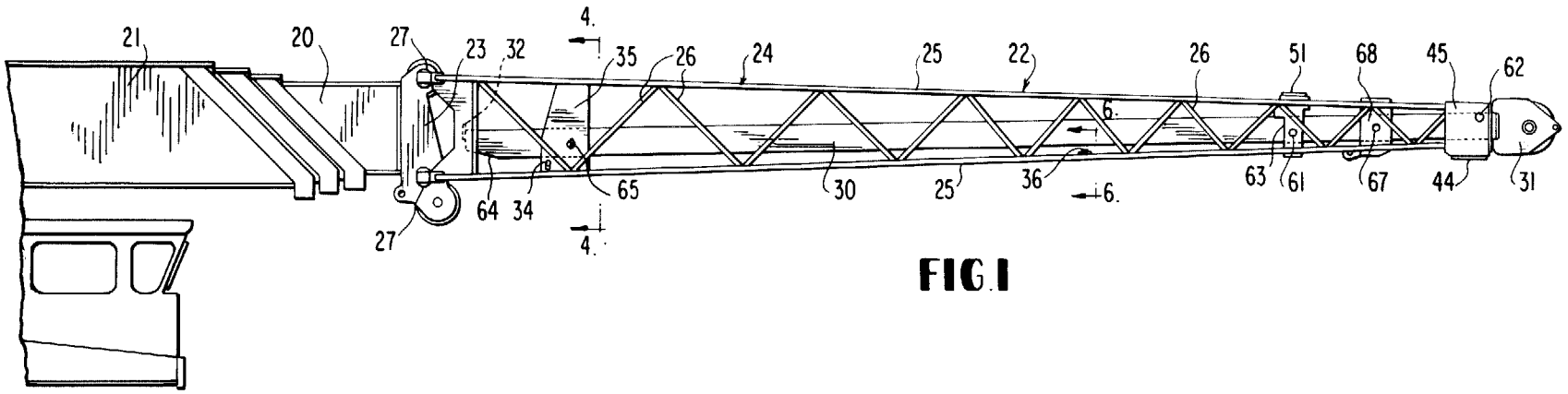
FIG. 1 is a side elevation of a telescopic extension jib for crane booms according to the invention with the jib attached to a boom in the use position and fully retracted.

Referring to the drawings in detail wherein like numerals designate like parts, attention being directed first to FIG. 1, the numeral 20 designates the fly section of a multi-section hydraulically operated telescoping crane boom including a base section 21. An extensible telescopic crane boom jib designated in its entirety by the numeral 22 in FIG. 1 is shown attached to the nose assembly 23 of boom fly section 20 in the use position of the jib, where the latter constitutes an extension of the crane boom to increase the reach thereof.

As illustrated in FIG. 1, the jib assembly 22 is of the side stowable type shown in U.S. Pat. No. 3,786,505, issued Jan. 15, 1974 to Keller. As shown in the Keller patent, the jib assembly is supported in a stowed or non-use position at one side of the boom base section with its base end forwardmost. The arrangement is such that the jib may be pivoted from its side stowed position to the extended use position ahead of the boom fly section which is the position illustrated in FIG. 1 of the present application. While the present invention is applicable to the side stowable arrangement and mounting of the Keller patent, it should be understood that the invention is equally applicable to other types of boom extension jibs, whether stowed on the crane boom in some manner during periods of non-use, or otherwise carried on the crane transport vehicle or even transported separately from the crane vehicle to a job site. It is also applicable for use on a manual fly section extendable from the next innermost boom section of a telescopic boom.

Continuing to refer to the drawings, the telescopic extension jib 22 comprises a stationary base section 24 of lattice-type construction having a rectangular cross section which gradually decreases in size toward its leading end. The jib base section 24 comprises four longitudinal corner bars 25 and suitable truss braces 26 at the top, bottom and sides of the lattice-type structure.

Figure 3:
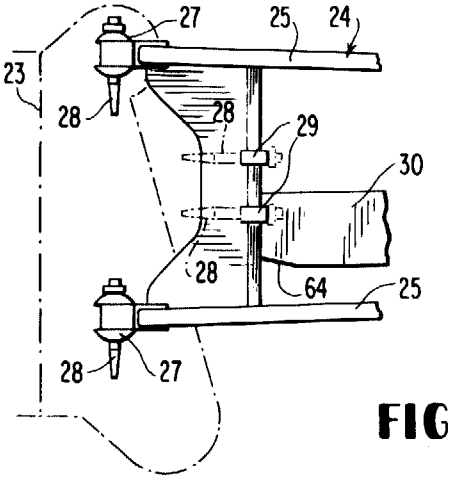
FIG. 3 is an enlarged fragmentary side elevation of the rear end portion of the jib in FIG. 1.

As disclosed in the Keller patent, the rearward or base ends of corner bars 25 are releasably pinned to transverse slotted shafts 27 carried by the nose assembly 23 by removable pins 28 which are stowed in holder sleeves 29 on the jib base section 24 for convenience, FIG. 3, while the jib is stowed in the non-use position. While this is a preferred arrangement for attaching the extensible telescopic jib to the crane boom, other types of connections may be employed, if desired.

The jib 22 additionally comprises an interior extensible or movable section 30 of box form in cross section and having parallel sides and parallel top and bottom walls. At its forward end, the movable jib section 30 is equipped with a jib nose 31 so that a suitable load can be supported on the extension jib. The rear end of movable jib section 30 carries a rigid upstanding stop plate 32 adapted to abut a fixed transverse bar 33 of the jib base section 24 to limit forward extension of the movable section 30 to the position shown in FIG. 2 where the two jib sections are socketed for a sufficient distance to be stable under loading.

To render manual manipulation of the movable jib section 30 feasible and quite easy, the movable section is guidingly supported on a system of low friction rollers which are carried by the stationary jib section 24. More particularly, a rear transverse horizontal fixed roller 34 is journaled near and above the bottom of the jib base section 24 on and between a pair of parallel vertical plates 35 whose tops and bottoms are rigidly secured to the jib section 24. The bottom of movable jib section 30 is adapted to rest on the rear roller 34 while in the retracted position, as in FIG. 1.

Figure 6:
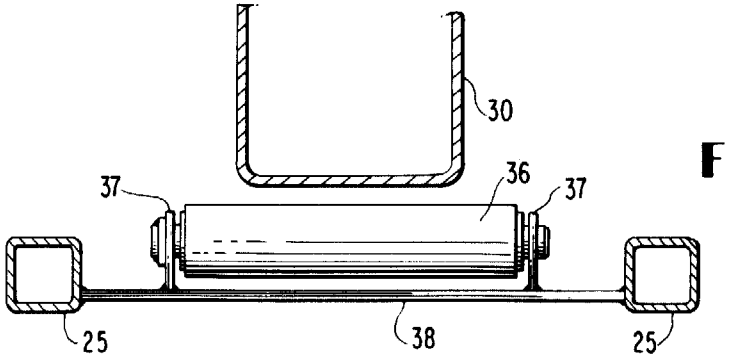
FIG. 6 is an enlarged fragmentary vertical section taken on line 6—6 of FIG. 1.

Referring to FIGS. 1 and 6, an intermediate fixed roller 36 is journalled for free rotation on a pair of bracket plates 37 which are rigidly attached to a bottom plate member 38 of jib section 24, said plate member extending between the two lower bars 25. The roller 36 is disposed a considerable distance rearwardly of the forward end of the jib base section 24.

As shown in FIGS. 10 through 14, a third roller 39 is provided substantially at the forward end of jib base section 24 and near the bottom thereof for the support and guidance of the movable jib section 30. This forward lower roller 39 is journaled for free rotation on spaced vertical brackets 40 which are rigidly secured to a horizontal base plate 41 supported at its corners yieldingly on four compression springs 42 which surround vertical guide rods 43 having their lower ends fixedly secured to a transverse horizontal plate or web 44, attached rigidly to side vertical plates 45 which are suitably rigidly attached to the jib base section 24. The arrangement is such that the spring-mounted foward roller 39 under certain circumstances, to be described, can move or retract downwardly and during such retraction, the base plate 41 is guided by the rods 43 which include upper heads 46, FIG. 11, to limit upward movement of the roller 39 under influence of the springs 42.

Figure 7:
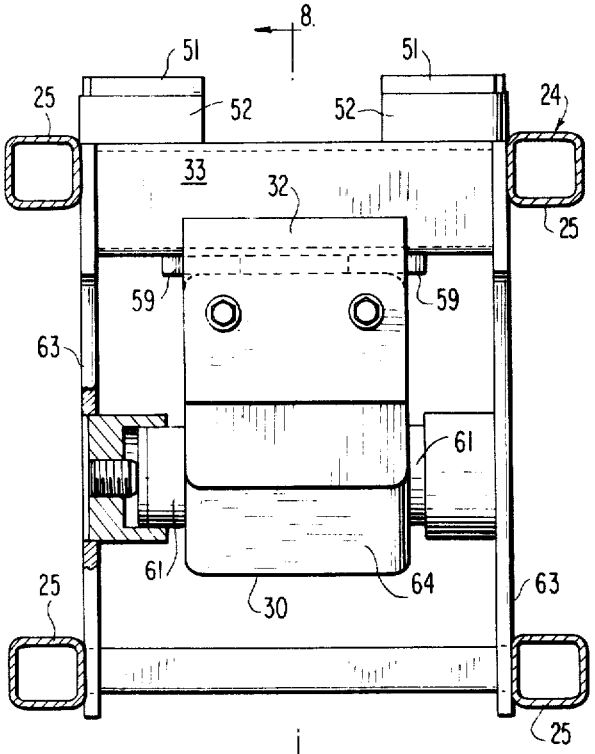
FIG. 7 is an enlarged transverse vertical section taken on line 7—7 of FIG. 2.
Figure 8:
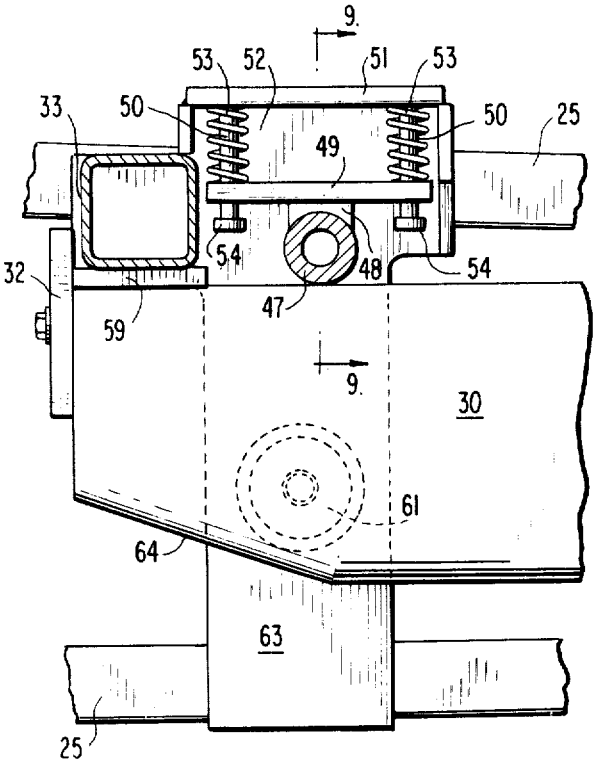
FIG. 8 is a fragmentary vertical section taken on line 8—8 of FIG. 7.
Figure 9:
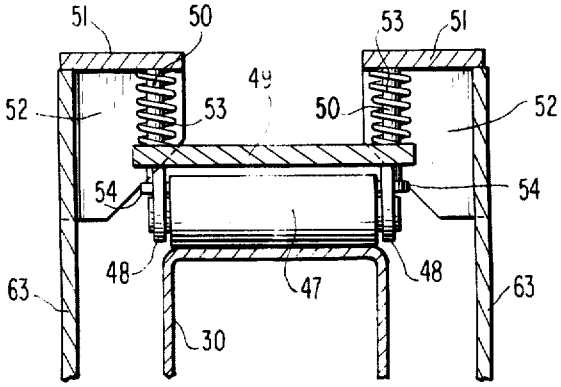
FIG. 9 is a fragmentary vertical section taken on line 9—9 of FIG. 8.

Rearwardly of the spring-mounted roller 39 is an upper spring-mounted roller 47, FIGS. 7 to 9, journaled for free rotation on a pair of bracket arms 48 which depend rigidly from an overhead mounting plate 49, guidingly supported for limited vertical movement on four corner vertical guide rods 50 whose upper ends are fixed to cap plates 51 slightly above the top of jib base section 24, the cap plates being horizontal. The two cap plates 51 are welded to supporting boxes 52 which partially enclose the rods 50 and a corresponding number of compression springs 53 which surround these rods with their tops bearing on the cap plates 51 and their bottoms bearing on roller mounting plate 49. The springs 53 urge the upper roller 47 downwardly at all times and this downward movement of the roller 47 with the mounting plate 49 is limited by heads 54 on the lower ends of the rods 50 which engage the bottom of plate 49 and stop the same.

Figure 2:
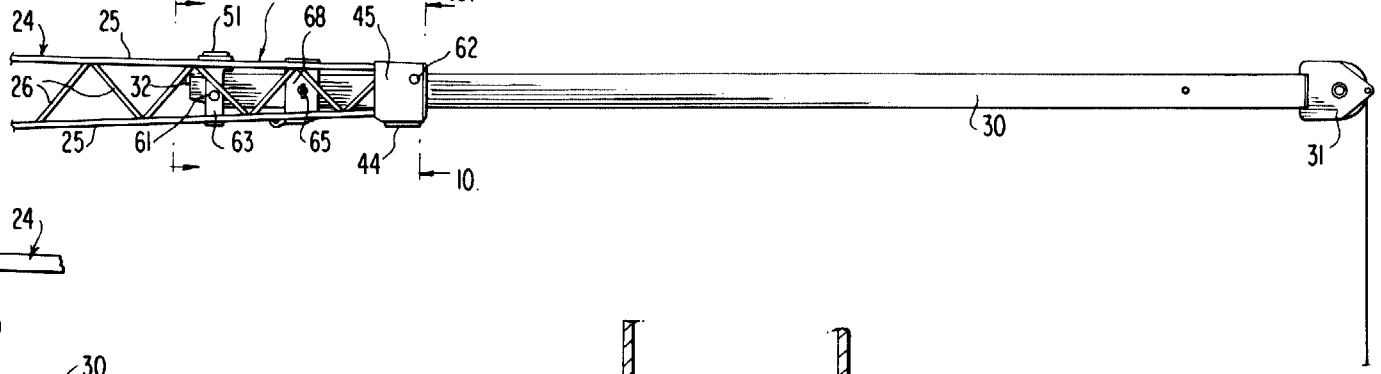
FIG. 2 is a fragmentary side elevation of the jib in the fully extended position.

It may now be observed that, when the movable jib section 30 is fully extended, FIG. 2, it is engaged at opposite ends of the socketing area between the two jib sections by the lower forward spring-mounted roller 39 and by the upper spring-mounted roller 47 at the rear of the socketing area. These two spring-mounted rollers are designed to support the dead weight of the movable jib section 30 with no external load thereon when the jib is fully extended, as shown in FIG. 2. The invention additionally provides cooperating flat bearing pad means to support the jib section 30 when the same is carrying a load so that the resulting stresses will be distributed over relatively wide areas rather than being concentrated on mere lines of contact with the rollers 39 and 47. As will be seen, the spring-mounted rollers 39 and 47 yield and retract automatically when the jib section 30 is loaded so that the flat bearing pads, now to be described, come into play and support the jib section 30 with the desired distribution of stresses.

More particularly, adjacent to the forward lower spring-supported roller 39 and slightly in advance thereof, FIGS. 11 and 12, a pair of laterally spaced bearing blocks or pads 55 having flat top faces are pivotally supported at a fixed elevation on a sturdy cross shaft 56 whose opposite ends are rigidly attached to the lower bars 25. Between the pivoted bearing pads 55, the shaft 56 is further supported by vertical plates 57 whose lower ends rest on the plate 44 and by a short horizontal weldment 58. The two bearing pads 55 lie under the two side webs of jib section 30, FIGS. 10 and 13, to support the same firmly at the forward end of the jib base section 24. The pads 55 are formed of steel for strength and because they are not utilized in sliding engagement with the movable jib section, but only to support the same and distribute stresses when the movable jib section is fixed in the extended position and under load. The two pads 55 are independently self-adjusting on the transverse shaft 56 so that their top flat faces will properly contact the bottom of the jib section 30 regardless of conditions of wear and/or slight misalignment of the long structure.

In a similar manner, upper stationary flat bearing pads 59 of steel are fixed to the bottom of the transverse bar 33 of jib base section 24 and positioned to engage the top wall of movable jib section 30 at the rear of the socketing zone when the jib is fully extended. The bearing pads 59 are horizontal and are not pivoted or self-adjusting like the forward lower pads 55. The pads 59 are above the side walls of movable jib section 30 and are positioned immediately rearwardly of upper spring-mounted roller 47 which yields and retracts upwardly automatically against the force of springs 53, when a load is placed on the jib section 30 so that the top and bottom of the latter at the opposite ends of the socketing areas between the two jib sections will then be supported by flat bearing plates, for good stress distribution and not by rollers or other localized contact elements which tend to concentrate stresses.

Additionally, the movable jib section 30 is stabilized laterally in the socketed zone within the base section 24 by a forward pair of transversely opposed adjustable wear pads 60 and a pair of similar rear side wear pads 61. The forward side wear pads 60 which are directly above the bearing pads 55, FIG. 11, are suitably secured to the adjacent upper bars 25 and associated parts. Openings 62 in the plates 45 permit access to the side wear pads 60 for adjustment purposes. The side wear pads 61 are supported by a pair of vertical plates 63, FIG. 7, which lie immediately inwardly of the bars 25 and are rigidly secured thereto as well as to the transverse bar 33 and adjacent parts of the jib base section 24.

Thus, it may now be understood that the movable jib section 30 is supported and guided at its opposite sides and at its top and bottom near opposite ends of the critical socketing zone with the base section 24, FIG. 2, when the jib is extended. The roller system including the two spring-mounted rollers 39 and 47 renders it easy for an operator to manually extend and retract the movable jib section 30. However, with the jib extended, FIG. 2, the two spring-mounted rollers 39 and 47 are only capable of supporting the unloaded section 30, and as soon as a load is placed on the jib, support will be taken over by the flat bearing pads 55 and 59, in the interest of stress distribution, as described.

It may be noted in FIGS. 1 and 6 that the intermediate support roller 36 is out of contact with the movable jib section 30 while the jib is retracted and the rear end of section 30 is being supported on the roller 34 and the forward end similarly supported on the spring-mounted roller 39. The rear end of jib section 30 has a short inclined face 64 on its lower side and during extension of the jib section 30, when the face 64 passes forwardly of roller 34, the weight of the jib section 30 is transferred to the roller 36. Conversely, during retraction of the section 30, the rollers 36 and 39 carry the movable section until the inclined face 64 passes over the roller 34, at which point the two bottom rollers 34 and 39 bear the weight of jib section 30 and intermediate roller 36 is again slightly spaced from jib section 30. This arrangement avoids the necessity for difficult and costly alignment between the tops of three rollers along the bottom of jib section 30, while assuring adequate support and guidance for the movable jib section in all positions.

It should be mentioned at this point that FIG. 7 and the views derived therefrom with the exception of FIGS. 13 and 14 show the condition where the extended jib is loaded. Hence, FIGS. 7 and 8 and FIGS. 10 and 11 show contact between the jib section 30 and the pads 59 and 55. FIGS. 13 and 14, however, are distorted to show the unloaded condition where only the dead weight of jib section 30 is being supported, in which case the pads 55 are spaced from the jib section 30 and the weight is being borne by the spring-mounted rollers 39. Similarly, although not shown in the drawings, when there is no load on the jib in the extended condition, the pads 59 are also spaced from the jib section 30.

Figure 4:
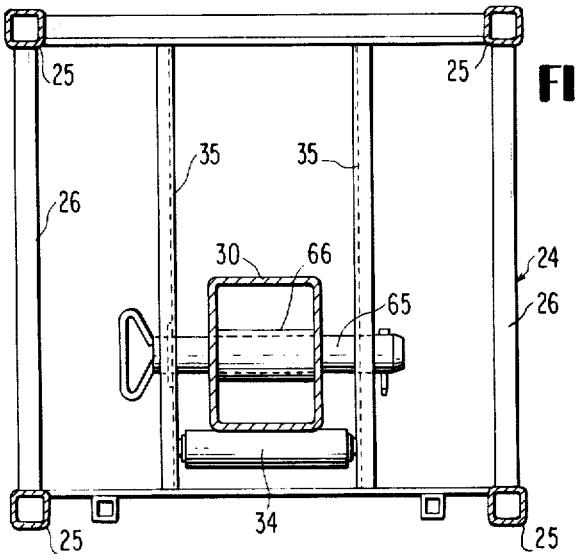
FIG. 4 is an enlarged transverse vertical section taken on line 4—4 of FIG. 1.
Figure 5:
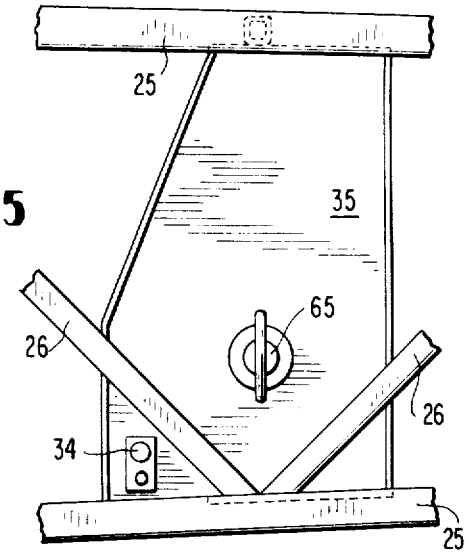
FIG. 5 is a fragmentary side elevation of the jib as depicted in FIG. 4.

A further feature of the invention, previously mentioned, is the provision of a locator pin 65, FIGS. 4 and 5, to lock the jib sections 30 and 24 against relative longitudinal movement in both the fully retracted position, FIG. 1, or the fully extended position, FIG. 2. As shown in FIGS. 1 and 4, where the jib is retracted, the locking locator pin 65 passes transversely through a fixed sleeve element 66 within the jib section 30 and through aligned locking openings in the adjacent plates 35. It may be noted that the same locator pin 65 is shown in FIG. 2 to lock the jib in the fully extended position. At this time, the pin 65 extends through transverse openings 67 of forward locking plate means 68 on the jib base section 24 substantially midway between the elements 63 and 45.

The extension jib can of course be employed on the crane in either a retracted or extended mode depending upon the requirements. The advantages of the invention over the prior art should now be apparent to those skilled in the art.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. An extension jib for crane booms comprising a stationary jib base section adapted for attachment to a crane boom, and an extensible and retractable movable jib section slidably mounted within said stationary jib section, said movable jib having top, bottom and side walls, longitudinally spaced opposing spring-urged rollers mounted on the stationary jib section, said rollers engaging the top and bottom walls of said movable jib section; each spring-urged roller comprising a freely rotatable transverse axis cylindrical roller of sufficient length to substantially span the width of the movable jib section, a mounting plate carrying said roller, headed guide pins engaged slidably with the mounting plate and allowing the mounting plate and roller to move toward and away from the adjacent wall of the movable jib section, and compression springs on said headed guide pins urging the mounting plate and roller toward the adjacent wall of the movable jib section, whereby the rollers bear the dead weight of the moving jib section when the latter is extended from the stationary jib section; and longitudinal spaced opposing bearing pad units mounted on the stationary jib adjacent the spring-urged rollers and engaging the top and bottom walls of the movable jib when the spring-urged rollers yield due to a load being placed on said movable jib section.

2. An extension jib for crane booms as defined by claim 1, and a releasable rigid locking means engagable with the two jib sections in the retracted and extended conditions of the jib to prevent accidental longitudinal relative movement between said stationary and movable jib sections.

3. An extension jib for crane booms as defined by claim 2, and cooperating positive stop elements on said stationary and movable jib sections to limit forward extension of the movable jib section relative to the stationary jib base section.

4. An extension jib for crane booms as defined by claim 1, and said movable jib section comprising an elongated rectangular cross section member, and said stationary jib section comprising a lattice-type member.

5. An extension jib for crane booms as defined by claim 1, wherein one pad unit is rockably mounted on an axis transverse to said jib.

6. An extension jib for crane booms as defined by claim 1, and the forwardmost of said pad units rockably mounted on an axis transverse to said jib.

7. An extension jib for crane booms as defined by claim 6, and said pad units each comprising a pair of laterally spaced flat faced steel bearing pads for direct engagement with the top and bottom walls of said movable jib section.

8. An extension jib for crane booms as defined by claim 1, and side adjustable longitudinally spaced wear pad units for the lateral guidance of the movable jib section on the stationary jib section.

* * * * *